US007318783B2

(12) United States Patent
Polando

(10) Patent No.: US 7,318,783 B2
(45) Date of Patent: Jan. 15, 2008

(54) ADJUSTABLE WEIGHT BROADHEAD ADAPTER BOLT AND ARROW

(76) Inventor: Scott A. Polando, 2945 Birch Grove Ct., Oxford, MI (US) 48370

( * ) Notice: Subject to any disclaimer, the term of this patent is extended or adjusted under 35 U.S.C. 154(b) by 0 days.

(21) Appl. No.: 11/164,554

(22) Filed: Nov. 29, 2005

(65) Prior Publication Data

US 2007/0123378 A1 May 31, 2007

(51) Int. Cl.
*F42B 6/08* (2006.01)

(52) U.S. Cl. ..... 473/578

(58) Field of Classification Search ..... 473/578, 473/582, 583, 584; 411/368, 389, 397
See application file for complete search history.

(56) References Cited

U.S. PATENT DOCUMENTS

| | | | | |
|---|---|---|---|---|
| 996,540 | A * | 6/1911 | Thornshaw | 411/317 |
| 1,291,303 | A * | 1/1919 | Warner | 220/243 |
| 2,416,548 | A * | 2/1947 | Schaul | 220/251 |
| 4,254,958 | A * | 3/1981 | Bateman, III | 473/583 |
| 5,137,282 | A | 8/1992 | Segar et al. | |
| 5,222,851 | A * | 6/1993 | Dickerson | 411/397 |
| 5,482,294 | A * | 1/1996 | Sullivan et al. | 473/584 |
| 5,613,968 | A * | 3/1997 | Lin | 606/61 |
| 6,027,421 | A * | 2/2000 | Adams, Jr. | 473/578 |
| 6,283,880 | B1 * | 9/2001 | Barrie | 473/584 |
| 6,290,903 | B1 | 9/2001 | Grace, Jr. et al. | |
| 6,540,628 | B1 * | 4/2003 | Musacchia, Jr. | 473/583 |
| 6,595,881 | B1 | 7/2003 | Grace, Jr. et al. | |
| 6,605,012 | B2 | 8/2003 | Muller | |
| 6,726,581 | B2 | 4/2004 | Muller | |
| 6,887,172 | B2 | 5/2005 | Arasmith | |
| 6,939,258 | B2 | 9/2005 | Muller | |
| 2005/0181898 | A1 | 8/2005 | Muller | |

* cited by examiner

*Primary Examiner*—John A. Ricci
(74) *Attorney, Agent, or Firm*—Gregory T. Zalecki

(57) ABSTRACT

A broadhead adapter is comprised of a collar and at least one broadhead blade. The collar is adapted to receive the stud of an adjustable weight broadhead adapter bolt through an opening. The collar is adapted to securely fit between an end of an arrow shaft and the shoulder of the bolt. Each blade is attached to the collar to form an arrowhead configuration. The adjustable weight bolt is comprised of a threaded stud, a shoulder, a boss and at least one weight. The threaded stud screws into the arrow shaft to secure a broadhead adapter to it. One or more weights are attached to the bolt to incrementally increase the effective weight of the arrowhead. An arrow having an adjustable weight broadhead arrowhead may be formed by securing a broadhead adapter between the shoulder of an adjustable weight broadhead adapter bolt and the threaded opening of an arrow shaft.

13 Claims, 6 Drawing Sheets

ADJUSTABLE WEIGHT BROADHEAD ADAPTER BOLT AND ARROW

BACKGROUND

Archers use different types of arrows for different purposes. Two commonly used types of arrows are field tip arrows and broadhead arrows. A field tip arrow has a conical pointed head. It is typically used for target practice. A common broadhead arrow has a plurality of tapered blades having cutting edges. The tapered blades converge at a tip and form an arrowhead configuration. A broadhead arrow is typically used for hunting. Modern arrow shafts have threaded inserts at one end. Typical field tips and broadhead arrowheads have projecting threaded studs adapted to thread into the threaded insert of an arrow shaft.

Because typical field tips and broadhead arrowheads have projecting threaded studs, arrowheads can be quickly removed and replaced. The original arrowhead is unscrewed from the arrow shaft. The replacement arrowhead is screwed into the arrow shaft. This permits a field tip arrow to be quickly converted to a broadhead arrow by facilitating the replacement of a field tip arrowhead on an arrow shaft with a broadhead arrowhead. Similarly, a broadhead arrow can be converted to a field tip arrow by replacing the broadhead arrowhead with a field tip arrowhead. Damaged arrowheads can also be repaired by unscrewing the damaged arrowhead from the arrow shaft and replacing it with another arrowhead.

It is desirable to reduce the weight and manufacturing cost of broadhead arrowheads. It is also desirable to provide an arrowhead which facilitates the conversion of a field tip arrow to a broadhead arrow while still maintaining the connection between the field tip arrowhead and the arrow shaft. Additionally, it is desirable for the broadhead arrow to have an arrowhead which has an adjustable weight. Archers often desire to control the aerodynamic properties and hunting properties of an arrow by adjusting the weight of the arrowhead.

What is needed is a broadhead adapter which facilitates the conversion of an arrow to a broadhead arrow wherein the adapter does not have a threaded stud. Instead, the broadhead adapter should have a collar through which the stud of an adjustable weight broadhead adapter bolt would fit for securing the adapter to an arrow shaft. The adapter should be able to be manufactured at a lower cost than current broadhead arrowheads. It should weigh less than similarly shaped current broadhead arrowheads. It should provide for the quick and economical repair of damaged broadheads. It should enhance and not detract from the aerodynamic properties of the arrow. The broadhead adapter should be capable of forming a fully functional broadhead arrow when the adapter is attached to an arrow shaft by a bolt, a field tip or an adjustable weight broadhead adapter bolt. The adjustable weight broadhead adapter bolt should be adapted to secure the broadhead adapter to an arrow shaft. The adjustable weight broadhead adapter bolt should permit the effective weight of the arrowhead attached to the arrow shaft to be incrementally adjusted by a adding or removing weights.

SUMMARY

These needs are satisfied by an adjustable weight broadhead adapter bolt, a broadhead adapter assembly and an arrow incorporating the broadhead adapter assembly as described herein. A broadhead adapter is comprised of a collar and at least one broadhead arrow blade. The collar has an opening. The collar is adapted to receive the stud of a shouldered fastener having a projecting stud, through the opening. The fastener can be a bolt having a threaded stud. Preferably, it is an adjustable weight broadhead adapter bolt. The collar is adapted to securely fit between one of the ends of an arrow shaft and the shoulder of a bolt, field tip or shouldered fastener having a projecting stud, when that projecting stud is inserted through the opening of the collar.

Broadhead arrow blades have elongated cutting edges. At least one broadhead arrow blade is attached to the collar. Many currently used broadhead arrow blades are generally triangular in shape. A generally triangular shaped broadhead arrow blade can be used with the broadhead adapter described herein, although such a shape is not necessary. The broadhead arrow blade is attached to the collar such that an arrowhead configuration is formed.

A threaded arrow field tip has a conical pointed tip at one end and a projecting stud at the other end. Other types of field tip tips, such as chisel tips, are also commonly available. The projecting stud of a field tip is attached to the pointed end portion of the field tip at a shoulder. The projecting stud usually has two diameters. The larger diameter portion of the stud is usually unthreaded and attached to the pointed end portion of the field tip. The smaller diameter portion of the stud is threaded such that it can be screwed into the end of an arrow shaft.

The broadhead adapter is intended to be attached to an arrow shaft. Most arrow shafts are cylindrical and therefore have a circular outer perimeter. The collar has an inner perimeter defining its opening. The collar also has an outer perimeter which is defined by its external periphery. Preferably, the outer perimeter of the collar has substantially the same dimensions as the outer perimeter of the arrow shaft at an end of the arrow shaft.

Commonly available arrow shafts have a threaded opening at one end. The threads of the threaded opening are contained within an insert. The insert is inserted into the end of the arrow shaft to create an arrow shaft having a threaded opening at one end. The entrance section of the insert is that section of the opening surface of the insert most distal to the arrow shaft-insert assembly. The entrance section is planar and perpendicular to the longitudinal axis of the insert. In order to minimize aerodynamic flight interference caused by the broadhead adapter, the outer perimeter of the collar may have the same dimensions as the outer perimeter of the entrance section of the threaded insert.

An arrow incorporating a broadhead adapter is comprised of an arrow shaft, a bolt and a broadhead adapter. The arrow shaft has a threaded opening at one end. The broadhead adapter is a broadhead adapter as described herein. The bolt has a threaded stud and a shoulder. The collar of the broadhead adapter is positioned between the shoulder of the bolt and the threaded opening of the arrow shaft. The broadhead adapter is securely attached to the end of the arrow shaft by meshing the threaded stud with the threads within the threaded opening of the arrow shaft. Thus, the broadhead adapter is secured to the arrow shaft by screwing the bolt into the threaded arrow shaft.

It may be desirable to minimize the overlap between the broadhead arrow blades of the broadhead adapter and the arrow shaft. When the broadhead adapter is attached to the arrow shaft any portion of the broadhead blades which extends into the area between the two ends of the arrow shaft will reduce the effective length of the arrow. In other words, the arrow when equipped with a field tip only, may be drawn back a certain maximum distance prior to releasing the arrow from the bow toward the target. The maximum draw distance is reduced by a small amount to a lesser distance when the blades of a broadhead adapter extend between the ends of the arrow shaft.

The preferred broadhead adapter avoids the extension of any broadhead blade, or part thereof, into the area between the ends of the arrow shaft. Each broadhead blade of the preferred embodiment has a forward end and a rearward end. Forward end and rearward end refer to the blade orientations when the broadhead adapter is secured to an arrow shaft. The forward end is most distal to the arrow shaft. The rearward end is most proximal to the arrow shaft. The rearward end of each blade is attached to the collar. Each broadhead blade is shaped to provide an opening for insertion, tightening and removal of the bolt or field tip. This is accomplished by configuring each blade so that a cavity within which the field tip or bolt sits when the adapter is attached to an arrow shaft is provided. The cavity should be sufficiently sized and shaped to allow for manual insertion, tightening and removal of a bolt or a field tip. Preferably, the broadhead adapter has two or three cutting edges surrounding the opening.

An adjustable weight broadhead adapter bolt is intended to be used for securing the collar of a broadhead adapter to an arrow shaft having a threaded opening at one end. An adjustable weight broadhead adapter bolt is comprised of a threaded stud and a shoulder. The threaded stud has two ends. One end is shaped, sized and threaded to screw into the threaded opening of the arrow shaft. The other end of the threaded stud is shaped and sized to receive a fastener. This can be accomplished by providing the threaded stud with uniform threads throughout its length.

The shoulder has a top side and a bottom side. The shoulder is positioned between the ends of the threaded stud. The shoulder is sized and shaped to secure the collar of the broadhead adapter to the threaded end of the arrow shaft.

Preferably, the adjustable weight broadhead adapter bolt further comprises a boss, at least one weight and a fastener. The boss is shaped to fit within an unthreaded portion of the threaded opening of the arrow shaft. The boss is positioned between the shoulder and the termination of the end of the threaded stud which is shaped, sized and threaded to screw into the threaded opening of the arrow shaft. The boss stabilizes the adjustable weight broadhead adapter bolt when the bolt is secured to an arrow shaft. The boss also aligns the adjustable weight broadhead adapter bolt with the arrow shaft when the bolt is secured to an arrow shaft.

Each weight has a central opening. Each weight is positioned contiguous to the shoulder such that the threaded stud passes through the opening of that weight. Preferably, each weight is washer shaped. The effective weight of an arrowhead attached to an arrow shaft with an adjustable weight broadhead adapter bolt can be incrementally modified by adding or removing weights to the threaded stud. The fastener is affixed to the end of the threaded stud which is shaped and sized to receive the fastener such that the fastener traps each weight between the shoulder and the fastener.

A broadhead adapter assembly is comprised of an adjustable weight broadhead adapter bolt, as described, and a broadhead adapter, as described. The collar of the broadhead adapter is positionable between the shoulder of the bolt and the threaded opening of the arrow shaft. The broadhead adapter is securely attachable to the end of the arrow shaft having the threaded opening by meshing the threaded stud with the threads within the threaded opening of the arrow shaft.

An improved arrow is comprised of an arrow shaft, an adjustable weight broadhead adapter bolt, as described, and a broadhead adapter, as described. The collar of the broadhead adapter is positioned between the shoulder of the bolt and the threaded opening of the arrow shaft. The broadhead adapter is securely attached to the end of the arrow shaft having the threaded opening by meshing the threaded stud with the threads within the threaded opening of the arrow shaft. The effective weight of the arrowhead may be incrementally adjusted by adding or removing weights from the bolt.

DRAWINGS

These and other features, aspects, and advantages of the present invention will become better understood with regard to the following description, appended claims, and accompanying drawings where:

DETAILED DESCRIPTION

Figure 5:
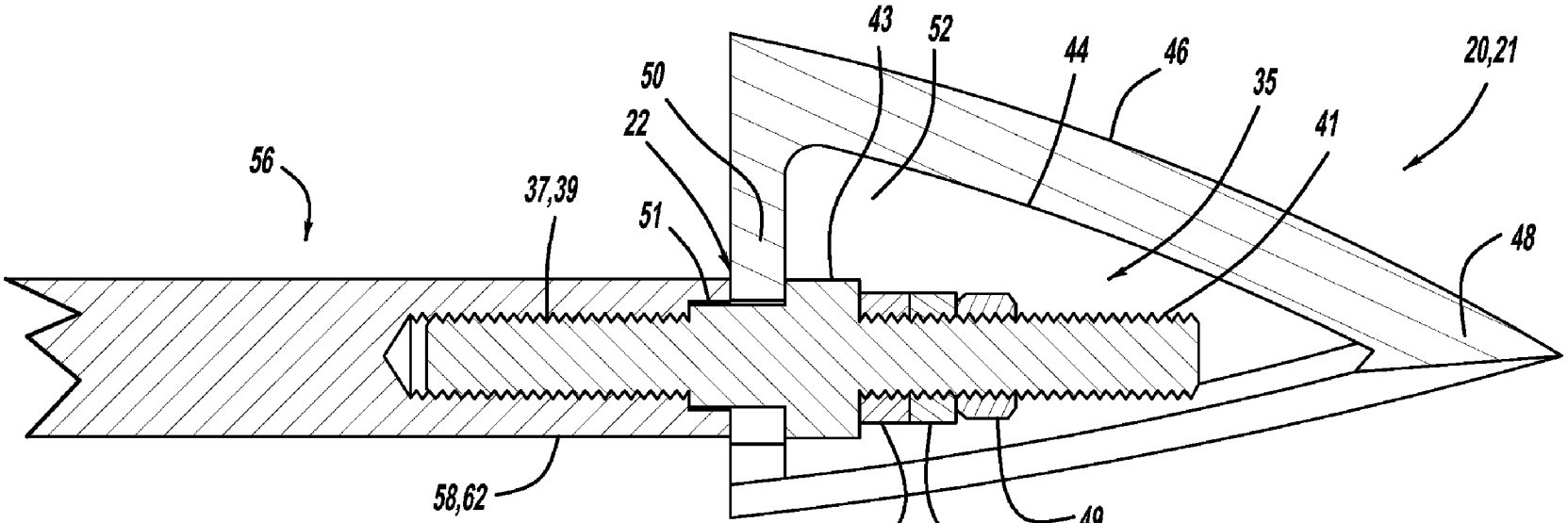
FIG. 5 is a sectional view of the arrow, the broadhead adapter and the adjustable weight broadhead adapter bolt of FIG. 2 using weights having a smaller diameter.
Figure 6:
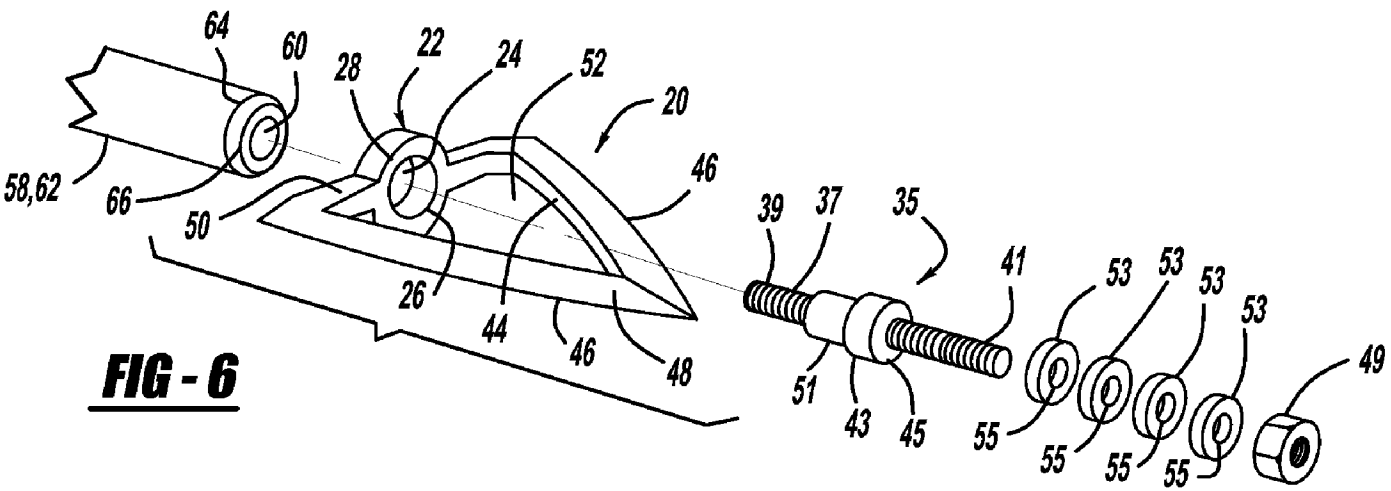
FIG. 6 is an exploded perspective view showing the assembly of an alternate embodiment of a broadhead adapter to an arrow shaft with an adjustable weight broadhead adapter bolt using a plurality of weights.
Figure 12:
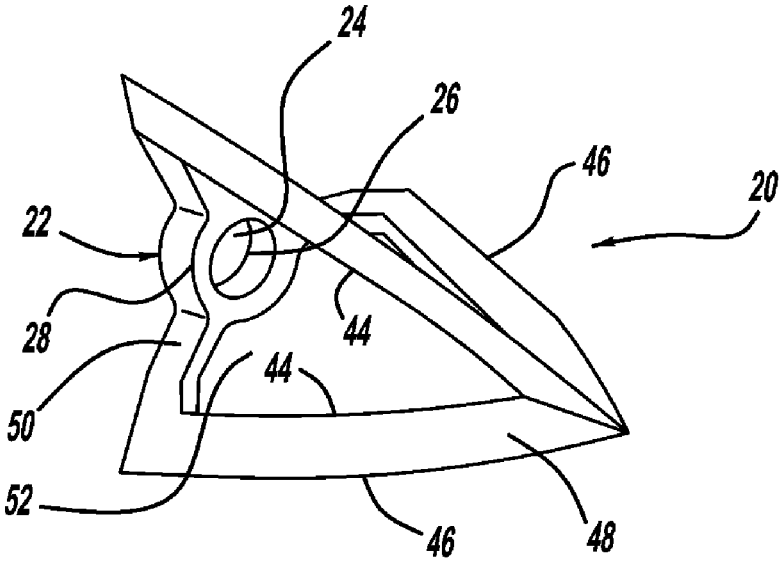
FIG. 12 is a perspective view of another embodiment of a broadhead adapter.
Figure 13:
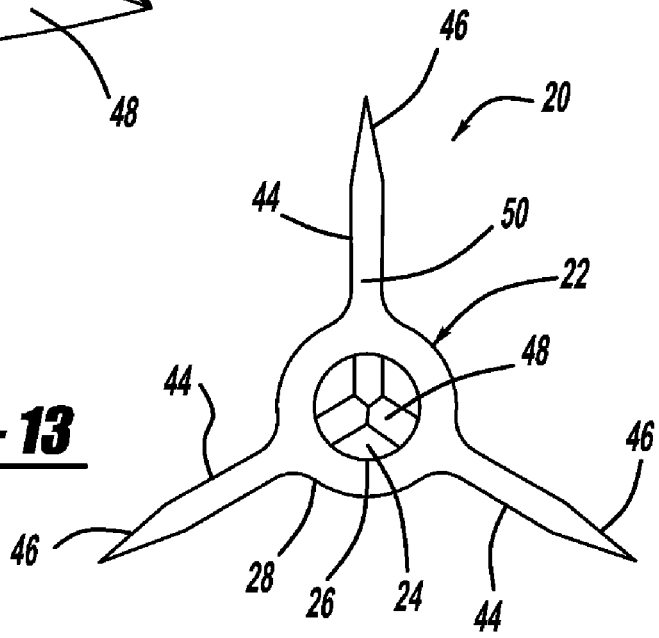
FIG. 13 is a bottom view of the broadhead adapter of FIG. 12.

Two embodiments of a broadhead adapter 20 are shown in FIGS. 6 and 12. FIGS. 2, 3, 5, 6, 7 and 8 depict partial views of arrows 56 incorporating a broadhead adapter 20. The preferred embodiment of a broadhead adapter 20 is shown in FIG. 12. Broadhead adapters 20 can be fabricated from plastic or metal. They can be produced by metal stamping. They can be produced by plastic injection molding. They can be produced by metal injection molding. The preferred fabrication method is metal injection molding.

Figure 1:
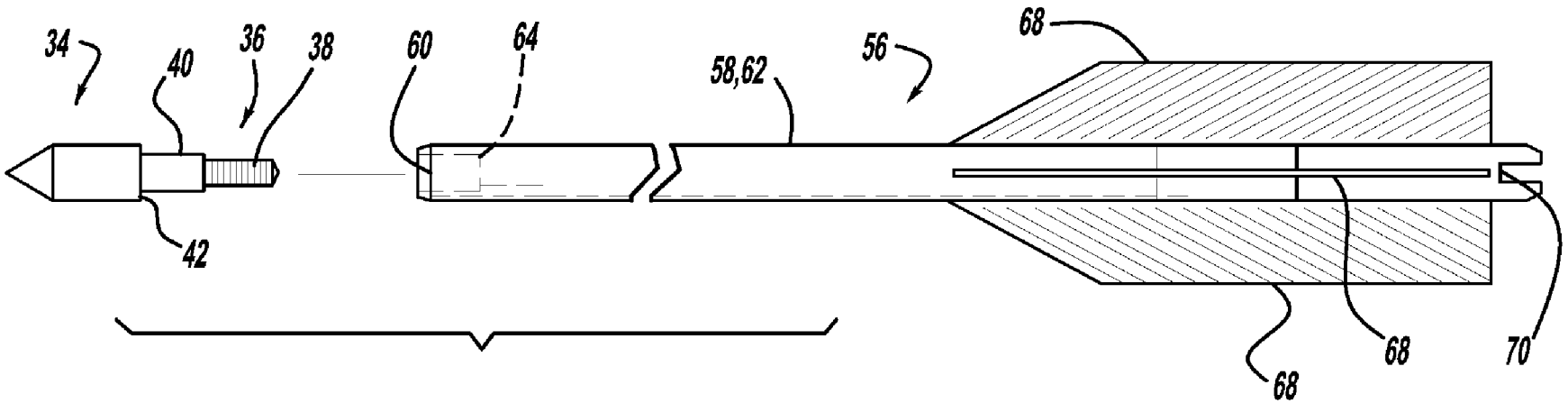
FIG - 1 Prior Art
FIG. 1 is an exploded plan view showing an arrow having an arrow shaft with a threaded opening at one end and a threaded field tip

A broadhead adapter 20 is intended to be attached to an arrow shaft 58. An exploded view of an arrow 56 is shown in FIG. 1. A common field tip arrow 56 is comprised of a threaded arrow field tip 34 and an arrow shaft 58. The arrow shaft 58 is cylindrical and has a circular outer perimeter 62 around its cross-section. One end of the arrow shaft 58 has a plurality of feathers 68 for flight guidance and a notch 70. The notch 70 is adapted to receive the drawstring of a bow and is the location where the drawstring imparts a flight propelling force to the arrow 56. The other end of the arrow shaft 58 has a threaded opening 60. The threads of the threaded opening 60 are provided by a threaded insert 64. The threaded insert 64 is inserted into the end of the arrow shaft 58 opposite the notch 70. The entrance section of the threaded insert 64 is the planar area which is perpendicular to the longitudinal axis of the arrow shaft 58 and which is most distal to the notch 70 of the arrow 56. The outer perimeter 66 of the entrance section of the threaded insert 64 is typically circular and is often smaller than the outer perimeter 62 of a cross-section of the arrow shaft 58.

A common threaded arrow field tip 34 is also shown in FIG. 1. The field tip 34 screws into the threaded insert 64 of the arrow shaft 58. The field tip 34 has a projecting stud 36. The projecting stud 36 attaches to a conical pointed head at a shoulder 42. The projecting stud 36 has a threaded portion 38 and an unthreaded portion 40. The unthreaded portion 40 of the projecting stud 36 attaches to the head of the field tip 34. The threaded portion 38 of the projecting stud 36 projects from the unthreaded portion 40. The threaded portion 38 of the projecting stud 36 is threaded such that it may be screwed into the threaded insert 64 of the arrow shaft 58. The head of the field tip 34 may have a shape other than the shape of a pointed cone. For example, the field tip 34 may have a chisel tip.

A broadhead adapter 20 is comprised of a collar 22 and at least one broadhead arrow blade 44. The collar 22 has an opening 24. The collar 22 is adapted to receive the stud 36 of a shouldered fastener 34 having a projecting stud 36. The projecting stud 36 is received through the opening 24 of the collar 22. Preferably, the shouldered fastener 34 is an adjustable weight broadhead adapter bolt 35, as described herein. It may be any type of fastener which has a projecting stud and a shoulder, so long as the projecting stud 36 is adapted to be releasably retained within an opening 60 of an arrow shaft 58. For example, spring-loaded detents may be used to secure the fastener 34 to the arrow shaft 58. The projecting stud 36 of the fastener 34 may also be releasably secured to the arrow shaft 58 by friction fitting the projecting stud 36 within the opening 60 of the arrow shaft 58. The broadhead adapter 20 will be secured to the arrow shaft 58 by the fastener 34.

The preferred shape of the collar 22 is substantially the shape of a common washer. The collar 22 should have a circular opening 24. The opening 24 is defined by an inner perimeter 26 of the collar 22. An outer perimeter 28 of the collar 22 is defined by the external periphery of the collar 22. Preferably, the outer perimeter 28 of the collar 22 is generally circular.

The preferred basic shape of the collar 22 is the shape of a washer. The opening 24 of the collar 22 has an inner perimeter 26 which allows the threaded stud 36 of a threaded arrow field tip 34, a bolt 34 or an adjustable weight broadhead adapter bolt 35 to pass through. The outer perimeter 28 of the collar 22 should have substantially the same dimensions as the outer perimeter 62 of the arrow shaft 58. In other words, the outer diameter of a washer shaped collar 22 should be substantially the same as the outer diameter of the arrow shaft 58 to which it is to be attached. By matching the outer perimeter 28 of the collar 22 to the outer perimeter 62 of the arrow shaft 58 flight characteristics of the arrow 56 will be enhanced. Such matching will minimize any adverse aerodynamic flight effects caused by the collar 22. Some threaded inserts 64 have a smaller cross-section diameter than the diameter of the arrow shaft 58, 62, as shown in FIG. 1. Additional optimization of the flight characteristics of the arrow may be obtained by fabricating the collar 22 such that its outer perimeter 28 has substantially the same dimensions as the outer perimeter 66 of the entrance section of the threaded insert 64 which has been inserted into the end of the arrow shaft 58. The collar 22 is adapted to securely fit between an end of an arrow shaft 58 and the shoulder of an adjustable weight broadhead adapter bolt 35, a bolt, a fastener or a field tip 34. These characteristics can be achieved by forming the collar 22 in the shape of a washer wherein the outside diameter 28 of the collar 22 is the same as the outside diameter 62 of the arrow shaft 58, and wherein the inside diameter 26 of the collar 22 forms an opening 24 having slightly larger dimensions than the diameter of the stud 36, 37 of the adjustable weight broadhead adapter bolt 35, the bolt, field tip, or fastener 34 intended to be inserted through it.

At least one broadhead arrow blade 44 is attached to the collar 22. Broadhead arrow blades 44 have elongated cutting edges 46. They are often triangular in shape. A broadhead arrow blade 44 may be attached to the collar 22 by a neck.

It is desirable to avoid having broadhead arrow blades 44 of a broadhead adapter 20 entering the area between the ends of the arrow shaft 58. As indicated above, when the broadhead arrow blades 44 enter into this area the effective draw length of the arrow 56 is reduced. This is because an arrow 56 loaded into a bow may be drawn back further when the arrow terminates only with a field tip 34 than when the broadhead arrow blades 44 enter the area between the ends of the arrow shaft 58.

Figure 7:
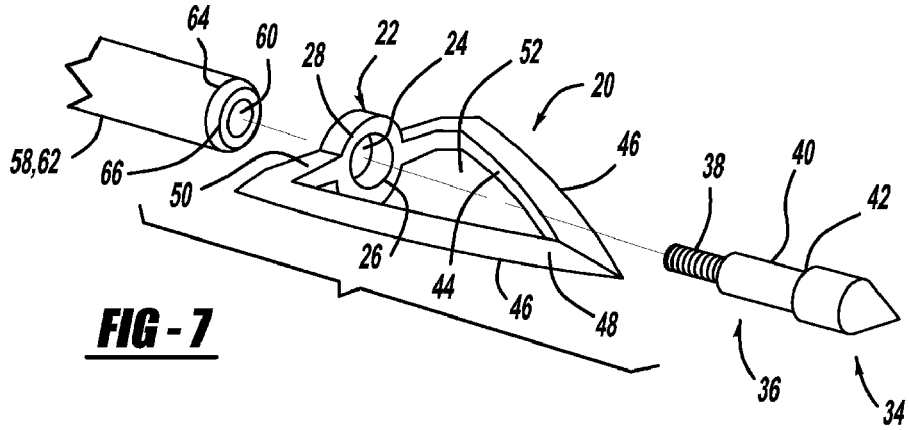
FIG. 7 is an exploded perspective view showing the assembly of the alternate embodiment of a broadhead adapter of FIG. 6 to an arrow shaft with a threaded field tip.
Figure 8:
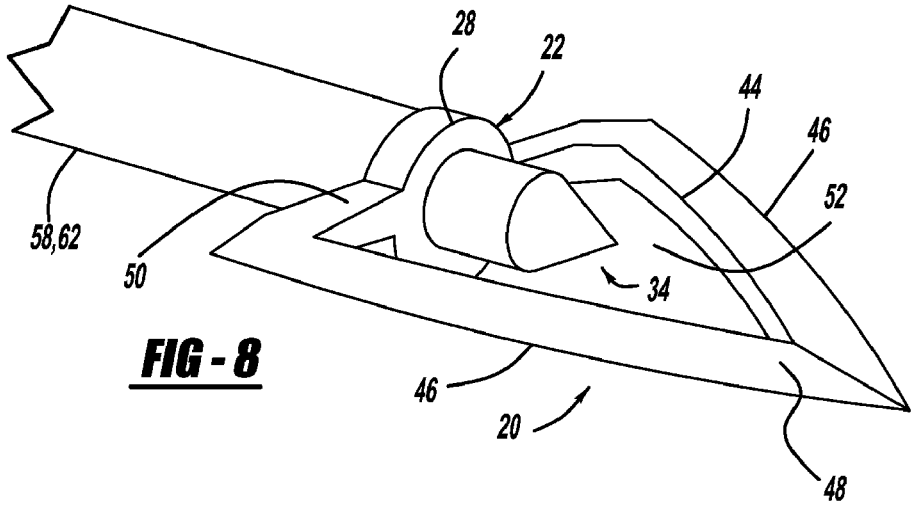
FIG. 8 is a perspective view of the arrow shaft, the broadhead adapter and the threaded field tip of FIG. 7 assembled together.
Figure 9:
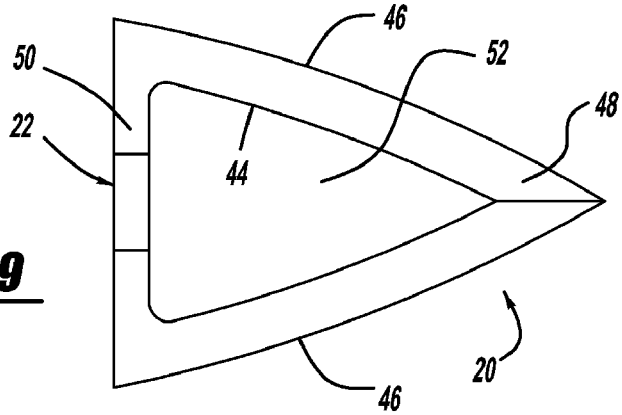
FIG. 9 is a side view of the broadhead adapter of FIG. 7.
Figure 10:
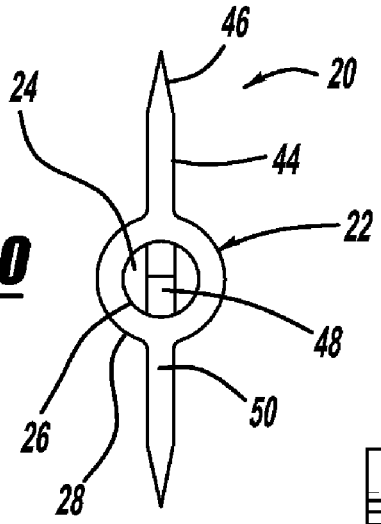
FIG. 10 is a bottom view of the broadhead adapter of FIG. 7.
Figure 11:
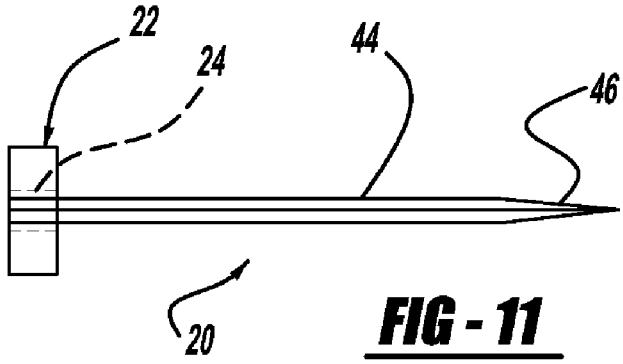
FIG. 11 is another side view of the broadhead adapter of FIG. 7, wherein the broadhead adapter has been rotated 90 degrees around its longitudinal axis relative to the orientation shown in FIG. 9.

The broadhead adapter 20 embodiments shown in FIG. 7 and FIG. 12 maintain the broadhead arrow blades 44 in a position that does not intrude into the area between the ends of the arrow shaft 58. The broadhead arrow blades 44 in those figures can be viewed as a single blade or as a combination of generally triangular blades 44 joined at a tip. Each broadhead arrow blade 44 has a forward end 48 and a rearward end 50. Forward end 48 and rearward end 50 refer to the blade orientations when the broadhead adapter 20 is secured to an arrow shaft 58. The rearward end 50 of each blade 44 is attached to the collar. Each broadhead blade 44 is shaped to provide an opening 52. The shape of the opening 52 permits insertion, tightening and removal of a bolt 34, a field tip 34 or an adjustable weight broadhead adapter bolt 35. This is accomplished by configuring each blade 44 so that a cavity 52 within which the field tip 34, or the adjustable weight broadhead adapter bolt 35, sits when the adapter 20 is attached to an arrow shaft 58 is provided, as shown in FIG. 8. The cavity 52 should be sufficiently sized and shaped to allow for manual insertion, tightening and removal of a bolt 34, a field tip 34 or an adjustable weight the broadhead adapter bolt 35. Preferably, the broadhead adapter 20 has two or three cutting edges 46 surrounding the opening 52, as shown in FIG. 8 and FIG. 12, respectively. The outer perimeter 28 of the collar 22 should be optimized to match the outer perimeter 62 of the arrow shaft 58 or the outer perimeter 66 of the threaded insert 64, as previously described.

Figure 4:
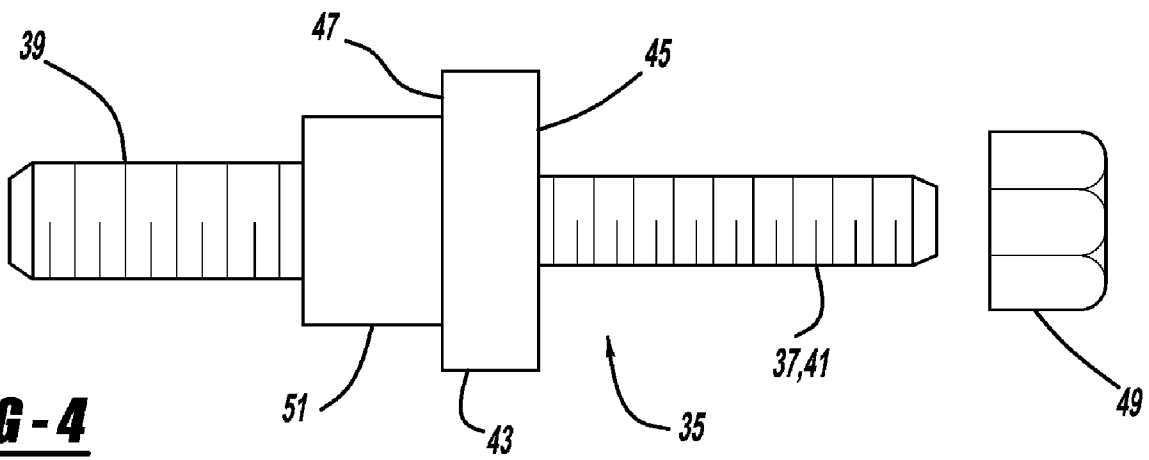
FIG. 4 is a perspective view of an adjustable weight broadhead adapter bolt.

The preferred embodiment of an adjustable weight broadhead adapter bolt 35 is shown in FIG. 4. It is comprised of a threaded stud 37, a shoulder 43, a boss 51, at least one weight 53 and a fastener 49. Preferably, the threaded stud 37 is fabricated from aluminum. The threaded stud 37 has two ends 39, 41. One end is an insertion end 39. The other end is a fastener end 41. The insertion end 39 is shaped, sized and threaded to screw into the threaded opening 60 of an arrow shaft 58. The threads of the insertion end 39 of the threaded stud 37 mate with the threads provided by the threaded opening 60 contained within the arrow shaft 58. The fastener end 41 of the threaded stud 37 is shaped and sized to receive a fastener. This can be accomplished by providing the fastener end 41 of the threaded stud 37 with threads which mate with the threads of a hex nut fastener 49. The fastener 49 may also be a friction fit fastener 49 which is adapted to be affixed to the fastener end 41 of the threaded stud 37, or the fastener 49 and the fastener end 41 of the threaded stud 37 may be provided with spring-loaded detents to secure the fastener 49 to the stud 37.

The shoulder 43 has a top side 45 and a bottom side 47. The shoulder 43 is positioned between the ends of the threaded stud 37, as shown in FIG. 4. The shoulder 43 is sized and shaped to secure the collar 22 of a broadhead adapter 20 to the threaded end of an arrow shaft 58. The shoulder 43 should be cylindrically shaped. The diameter of the cylindrical shape should not exceed the diameter of the outer perimeter 28 of the collar 22 of the broadhead adapter 20. This will minimize any aerodynamic flight interference during the flight of the arrow 56 caused by the shoulder 43.

The threads within the threaded opening 60 of an arrow shaft 58 are typically provided by a threaded insert 64. Usually, an unthreaded portion of the threaded opening 60 leads from the end of the arrow shaft 58 to a threaded portion of the threaded opening 60. The unthreaded portion of the threaded opening 60 of an arrow shaft 58 is shown in FIG. 1 by the phantom rectangle terminating at the end of the arrow shaft 58. The boss 51 is shaped to fit within this unthreaded portion of the threaded opening 60 of the arrow shaft 58. The boss 51 is positioned between the shoulder 43 and the termination of the end 39 of the threaded stud 37 which is shaped, sized and threaded to screw into the threaded opening 60 of the arrow shaft 58. The boss 51 should be cylindrically shaped. It is analogous to the unthreaded part 40 of the field tip 34 shown in FIG. 1. The boss 51 stabilizes the adjustable weight broadhead adapter bolt 35 when the bolt 35 is secured to the arrow shaft 58. The adjustable weight broadhead adapter bolt 35 also aligns the bolt 35 with the arrow shaft 58 when the bolt 35 is secured to the arrow shaft 58.

Preferably, the shoulder 43 and the boss 51 are fabricated by overmolding plastic onto the threaded stud 37. The shoulder 43 and the boss 51 may also be fabricated by using a screw machine to cut their configurations from the same stock from which the threaded stud 37 is fabricated.

Figure 2:
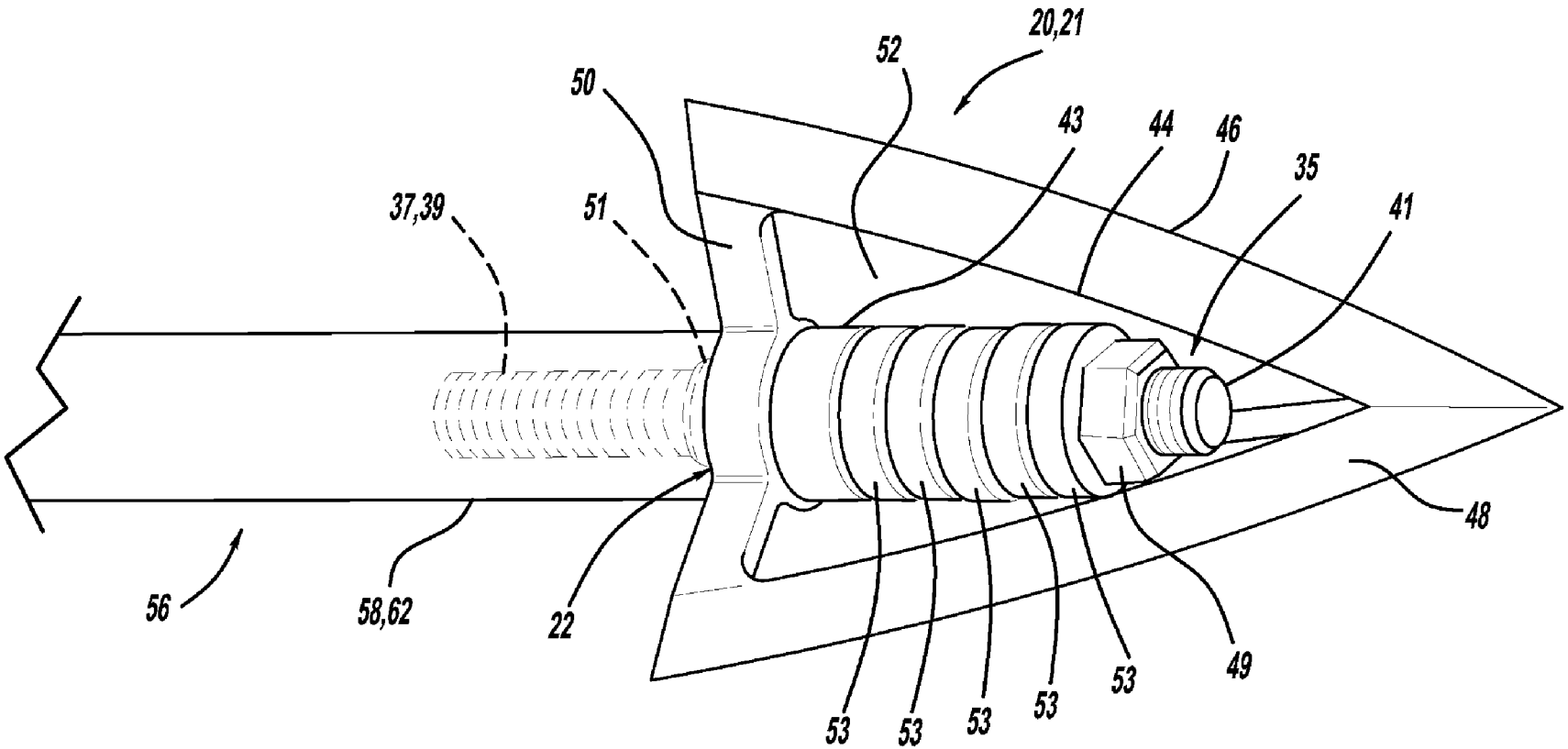
FIG. 2 is a partial perspective view of an arrow having a broadhead adapter secured to its shaft by an adjustable weight broadhead adapter bolt having a plurality of weights attached to it.
Figure 3:
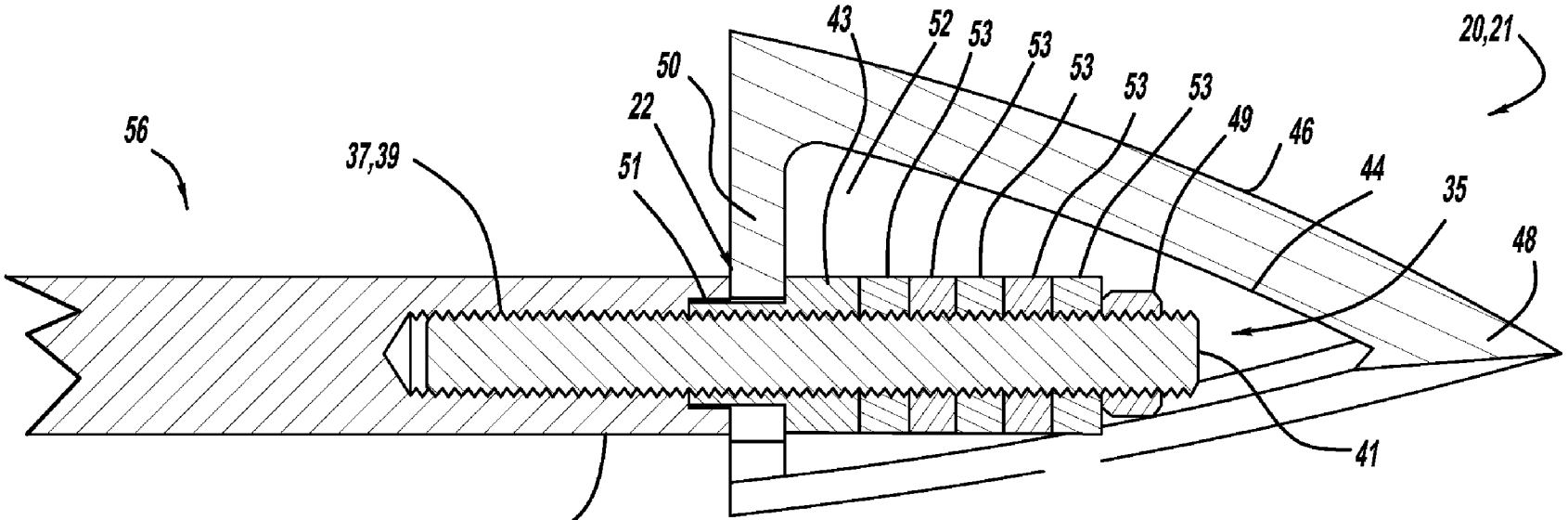
FIG. 3 is a sectional view of the arrow, the broadhead adapter and the adjustable weight broadhead adapter bolt of FIG. 2.

The adjustable weight broadhead adapter bolt 35 may be used without any weights 53. However, the adjustable weight broadhead adapter bolt 35 is intended to be used with at least one weight 53. Each weight 53 has a central opening 55, as shown in FIG. 6. Preferably, each weight 53 is in the form of a washer. As such, its outer diameter and its opening 55 are circular and the thickness of each weight 53 is less than the outer diameter of that weight 53. Each weight 53 is positioned contiguous to the shoulder 43 such that the fastener end 41 of the threaded stud 37 passes through the opening 55 of each at least one weight 53. The term contiguous to the shoulder is deemed to include a stack of weights 53 set on the top side 45 of the shoulder 43. This is shown in FIG. 2. The effective weight of an arrowhead comprised of a broadhead adapter 20 secured to an arrow shaft 58 by a broadhead adapter bolt 35 may be incrementally adjusted by adding or removing weights 53 from the threaded stud 37. The diameter of the weights 53 should not exceed the diameter of the shoulder 43, or the diameter of the collar 22 of the broadhead adapter 20, as shown in FIG. 2. This will minimize any aerodynamic flight interference caused by the weights 53. The weights 53 may have a smaller diameter, or a smaller external periphery, than the shoulder 43 or the collar of 22, as shown in FIG. 5. The preferred material from which the weights 53 are fabricated is steel. Other materials, such as plastic or nylon, are also suitable.

The preferred fastener 49 is a nylon hex nut. The fastener is used to secure the weights 53 to the adjustable weight broadhead adapter bolt 35.

An arrow 56 incorporating a broadhead adapter 20 is comprised of a broadhead adapter 20, a bolt 34 and an arrow shaft 58. The arrow shaft 58 has a threaded opening 60 at one end. The threaded opening 60 should be provided by a threaded insert 64 inserted into an end of the arrow shaft 58, as previously described. The other end of the arrow shaft 58 is equipped with feathers 68 and a notch 70, as shown in FIG. 1. The bolt 34 has a threaded stud 36 projecting from it. A shoulder is provided where the stud 36 meets the head of the bolt 34. Preferably, the bolt 34 is an adjustable weight broadhead adapter bolt 35, as described herein. However, it may be a shouldered fastener having a projecting stud, as previously described. The broadhead adapter 20 is as previously described. Any of the described embodiments may be used. In order to form an arrow 56 the collar 22 of the broadhead adapter 20 is positioned between the shoulder 42 of the bolt 34 (or the shoulder 43 of the adjustable weight broadhead adapter bolt 35) and the threaded opening 60 of the arrow shaft 58. The broadhead arrow blades 44 are oriented to form an arrowhead configuration at the end of the arrow shaft 58 having the threaded opening 60. The broadhead adapter 20 is securely attached to the end of the arrow shaft 58 by threading the threads of the bolt 34 (or the threaded stud 37 of the broadhead adapter bolt 35) into the threads of the threaded opening 60 of the arrow shaft 58. The threads of the threaded stud 36, 37, 38 are meshed with the threads within the threaded opening 60 of the arrow shaft 58. The threads within the threaded opening 60 of the arrow shaft 58 are provided by the threaded insert 64.

A broadhead adapter assembly 21 is comprised of an adjustable weight broadhead adapter bolt 35, as described, and a broadhead adapter 20, as described. The collar 22 of the broadhead adapter 20 is positionable between the shoulder 43 of the broadhead adapter bolt 35 and the threaded opening 60 of an arrow shaft 58. The broadhead adapter 20 is securely attachable to the end of the arrow shaft 58 having the threaded opening 60. This is accomplished by placing the insertion end 39 of the threaded stud 37 through the opening 24 of the collar 22 of the broadhead adapter 20 and by meshing the threads of the insertion end 39 of the threaded stud 37 with the threads within the threaded opening 60 of the arrow shaft 58.

An improved arrow 56 is comprised of an arrow shaft 58 having a threaded opening 60 at one end, an adjustable weight broadhead adapter bolt 35, as described, and a broadhead adapter 20, as described. The collar 22 of the broadhead adapter 20 is positioned between the shoulder 43 of the adjustable weight broadhead adapter bolt 35 and the threaded opening 60 of the arrow shaft 58. The broadhead adapter 20 is securely attached to the end of the arrow shaft 58 having the threaded opening 60 by inserting the insertion end 39 of the threaded stud 37 through the opening 24 of the collar 22 of the broadhead adapter 20 and by meshing the threads of the threaded stud 37 with the threads within the threaded opening 60 of the arrow shaft 58. In other words, the adjustable weight broadhead adapter bolt 35 is screwed into the threaded opening 60 of the arrow shaft 58 to secure the broadhead adapter 20 to the arrow shaft 58.

The effective weight of the arrowhead of the improved arrow 56 can be incrementally adjusted. The lowest weight is obtained when no weights 53 and no fastener 49 are attached to the insertion end 39 of the threaded stud 37. The effective weight of the arrowhead can be incrementally increased by placing one or more weights 53 over the insertion end 39 of the threaded stud 37 between the shoulder 43 and of the fastener 49. The fastener 49 should be a hex nut screwed onto the insertion end 39 of the threaded stud 37. The effective weight of the arrowhead is increased by adding weights 53. It is reduced by removing weights 53.

In order to convert a field tip arrow 56 into a broadhead arrow 56 the field tip 34 is removed by unscrewing it. The collar 22 of a broadhead adapter 20 is positioned between the shoulder 42 of the threaded arrow field tip 34 (or the shoulder 43 of the adjustable weight broadhead adapter bolt 35) and the threaded opening 60 of the arrow shaft 58. The broadhead adapter 20 is securely attached to the end of the arrow shaft 58 by threading the threads of the field tip 34 (or the threaded stud 37 of the adjustable weight broadhead adapter bolt 35) into the threads of the threaded opening 60 of the arrow shaft 58 and tightening the field tip 34 or the adjustable weight broadhead adapter bolt 35. In order to convert the arrow 56 back into a field tip arrow 56 the process is reversed. The field tip 34 (or the adjustable weight broadhead adapter bolt 35) is unscrewed from the threaded opening 60 of the arrow shaft 58 and the broadhead adapter 20 is removed. The threaded arrow field tip 34 is screwed back into the threaded opening 60 of the arrow shaft 58, thereby converting the arrow 56 into a field tip arrow 56. A damaged broadhead adapter 20 may be easily replaced. The field tip 34, bolt 34 or adjustable weight broadhead adapter bolt 35 is unscrewed from the arrow shaft 58. The damaged broadhead adapter 20 is removed and replaced by an undamaged broadhead adapter 20. The undamaged broadhead adapter 20 is then secured by tightening the field tip 34, bolt 34 or adjustable weight broadhead adapter bolt 35.

The broadhead adapter 20 does not have a threaded stud. The broadhead adapter 20 facilitates the conversion of a field tip arrow 56 to a broadhead arrow 56. The broadhead adapter 20 can be manufactured at a lower cost than current broadhead arrowheads because it contains less material than similarly shaped broadhead arrowheads and it does not require the machining, or otherwise providing, of threads onto a stud. The broadhead adapter 20 provides for the quick and economical repair of damaged arrowheads. It also provides for the quick conversion of a field tip arrow 56 to a broadhead arrow 56 and the conversion of a broadhead arrow 56 to a field tip arrow 56. The broadhead adapter 20 does not adversely affect the aerodynamic properties of an arrow 56. The broadhead adapter 20 is capable of forming a fully functional broadhead arrow 56 when the adapter 20 is attached to an arrow shaft 58 by a field tip 34.

When an adjustable weight broadhead adapter bolt 35 is used to secure a broadhead adapter 20 to an arrow shaft 58 an archer has the ability to fine tune the effective weight of the arrowhead. Minimal effective weight is obtained by attaching no weights 53 and no fastener 49 to the adjustable weight broadhead adapter bolt 35. Progressively increasing effective arrowhead weights are obtained by progressively adding weights 53 to the insertion end 39 of the threaded stud 37 and securing those weights 53 to the shoulder 43 of the adjustable weight broadhead adapter bolt 35 by a hex nut fastener 49. Minimal aerodynamic flight interference is caused by the weights 53 and the broadhead adapter bolt 35.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions and methods insofar as they do not depart from the spirit and scope of the present invention.

What is claimed is:

1. An adjustable weight broadhead adapter bolt for securing the collar of a broadhead adapter to an arrow shaft having a threaded opening at one end, said bolt comprising:

a threaded stud having two ends, wherein one end is shaped, sized and threaded to screw into the threaded opening of the arrow shaft and wherein the other end of the threaded stud is shaped and sized to receive a fastener;

a shoulder having a top side and a bottom side positioned between the ends of the threaded stud, said shoulder being sized and shaped to secure the collar of the broadhead adapter to the threaded end of the arrow shaft;

a fastener affixed to the end of the threaded stud which is shaped and sized to receive a fastener; and a boss shaped to fit within an unthreaded portion of the threaded opening of the arrow shaft, said boss being positioned between the shoulder and the termination of the end of the threaded stud which is shaped, sized and threaded to screw into the threaded opening of the arrow shaft, for stabilizing the adjustable weight broadhead adapter bolt when it is secured to an arrow shaft and for aligning the adjustable weight broadhead adapter bolt with the arrow shaft when the bolt is secured to an arrow shaft.

2. The adjustable weight broadhead adapter bolt of claim 1, further comprising at least one weight having a central opening, each said at least one weight being positioned contiguous to the shoulder such that the threaded stud passes through the opening of each at least one weight.

3. An adjustable weight broadhead adapter bolt for securing the collar of a broadhead adapter to an arrow shaft having a threaded opening at one end, said bolt comprising:

a threaded stud having two ends, wherein one end is shaped, sized and threaded to screw into the threaded opening of the arrow shaft and wherein the other end of the threaded stud is shaped and sized to receive a fastener;

a shoulder having a top side and a bottom side positioned between the ends of the threaded stud, said shoulder being sized and shaped to secure the collar of the broadhead adapter to the threaded end of the arrow shaft;

a boss shaped to fit within an unthreaded portion of the threaded opening of the arrow shaft, said boss being positioned between the shoulder and the termination of the end of the threaded stud which is shaped, sized and threaded to screw into the threaded opening of the arrow shaft, for stabilizing the adjustable weight broadhead adapter bolt when the bolt is secured to an arrow shaft and for aligning the adjustable weight broadhead adapter bolt with the arrow shaft when the bolt is secured to an arrow shaft; and at least one weight having a central opening, each said at least one weight being positioned contiguous to the shoulder such that the threaded stud passes through the opening of each at least one weight.

4. The adjustable weight broadhead adapter bolt of claim 3, further comprising a fastener affixed to the end of the threaded stud which is shaped and sized to receive a fastener.

5. The adjustable weight broadhead adapter bolt of claim 3, wherein each said at least one weight is washer shaped.

6. A broadhead adapter assembly comprising:

an adjustable weight broadhead adapter bolt for securing the collar of a broadhead adapter to an arrow shaft having a threaded opening at one end, said bolt comprising:

a threaded stud having two ends, wherein one end is shaped, sized and threaded to screw into the threaded opening of the arrow shaft and wherein the other end of the threaded stud is shaped and sized to receive a fastener;

a shoulder having a top side and a bottom side positioned between the ends of the threaded stud, said shoulder being sized and shaped to secure the collar of the broadhead adapter to the threaded end of the arrow shaft; and a fastener affixed to the end of the threaded stud which is shaped and sized to receive a fastener; and a broadhead adapter comprising:

a collar having an opening, said collar being adapted to receive the stud of the bolt through the opening and said collar being further adapted to securely fit between the end of the arrow shaft having the threaded opening and the shoulder of the bolt; and at least one broadhead arrow blade attached to the collar to form an arrowhead configuration;

said collar being positionable between the shoulder of the bolt and the threaded opening of an arrow shaft; and said broadhead adapter being securely attachable to the end of the arrow shaft having the threaded opening by meshing the threaded stud with the threads within the threaded opening of the arrow shaft.

7. The broadhead adapter assembly of claim 6, further comprising a boss shaped to fit within an unthreaded portion of the threaded opening of the arrow shaft, said boss being positioned between the shoulder and the termination of the end of the threaded stud which is shaped, sized and threaded to screw into the threaded opening of the arrow shaft, for stabilizing the adjustable weight broadhead adapter bolt when it is secured to an arrow shaft and for aligning the adjustable weight broadhead adapter bolt with the arrow shaft when the bolt is secured to an arrow shaft.

8. The broadhead adapter assembly of claim 6, further comprising at least one weight having a central opening, each said at least one weight being positioned contiguous to the shoulder such that the threaded stud passes through the opening of each at least one weight.

9. The broadhead adapter assembly of claim 8, wherein each said at least one weight is washer shaped.

10. An arrow comprising:

an arrow shaft having a threaded opening at one end;

an adjustable weight broadhead adapter bolt for securing the collar of a broadhead adapter to an arrow shaft having a threaded opening at one end, said bolt comprising:

a threaded stud having two ends, wherein one end is shaped, sized and threaded to screw into the threaded opening of the arrow shaft and wherein the other end of the threaded stud is shaped and sized to receive a fastener;

a shoulder having a top side and a bottom side positioned between the ends of the threaded stud, said shoulder being sized and shaped to secure the collar of the broadhead adapter to the threaded end of the arrow shaft; and a fastener affixed to the end of the threaded stud which is shaped and sized to receive a fastener; and a broadhead adapter comprising:

a collar having an opening, said collar being adapted to receive the stud of the bolt through the opening and said collar being further adapted to securely fit between the end of the arrow shaft having the threaded opening and the shoulder of the bolt; and at least one broadhead arrow blade attached to the collar to form an arrowhead configuration;

said collar being positioned between the shoulder of the bolt and the threaded opening of the arrow shaft; and said broadhead adapter being securely attached to the end of the arrow shaft having the threaded opening by meshing the threaded stud with the threads within the threaded opening of the arrow shaft.

11. The arrow of claim 10, further comprising a boss shaped to fit within an unthreaded portion of the threaded opening of the arrow shaft, said boss being positioned between the shoulder and the termination of the end of the threaded stud which is shaped, sized and threaded to screw into the threaded opening of the arrow shaft, for stabilizing the adjustable weight broadhead adapter bolt when it is secured to an arrow shaft and for aligning the adjustable weight broadhead adapter bolt with the arrow shaft when the bolt is secured to an arrow shaft.

12. The arrow of claim 10, further comprising at least one weight having a central opening, each said at least one weight being positioned contiguous to the shoulder such that the threaded stud passes through the opening of each at least one weight.

13. The arrow of claim 12, wherein each said at least one weight is washer shaped.

* * * * *